United States Patent [19]

Hattori et al.

[11] Patent Number: 4,616,985

[45] Date of Patent: Oct. 14, 1986

[54] VANE TYPE COMPRESSOR HAVING AN IMPROVED ROTATABLE SLEEVE

[75] Inventors: Toshihiko Hattori; Yuji Akagi; Hideo Kohara, all of Hiroshima, Japan

[73] Assignee: Mazda Motor Corporation, Hiroshima, Japan

[21] Appl. No.: 595,493

[22] Filed: Mar. 30, 1984

[30] Foreign Application Priority Data

Mar. 31, 1983 [JP] Japan ..... 58-57619

[51] Int. Cl.[4] ..... F04C 29/00

[52] U.S. Cl. ..... 418/173; 418/178; 418/179

[58] Field of Search ..... 418/173, 178, 179

[56] References Cited

U.S. PATENT DOCUMENTS

| | | | |
|---|---|---|---|
| 3,020,219 | 2/1962 | Franklin et al. | 204/58 |
| 3,982,864 | 9/1976 | Cain | 418/179 X |
| 4,074,956 | 2/1978 | Maruyama et al. | 418/179 X |
| 4,197,061 | 4/1980 | Hill | 418/173 |
| 4,456,436 | 6/1984 | Schillinger et al. | 418/179 |

FOREIGN PATENT DOCUMENTS

| | | | |
|---|---|---|---|
| 2421906 | 11/1975 | Fed. Rep. of Germany | 418/152 |
| 49-23322 | 6/1974 | Japan . | |

OTHER PUBLICATIONS

S. Ito et al., "Displacement Type Compressors," published Jun. 1970 by the Sangyo Tosho K.K. (also partial translation).

Lindberg, R. A., *Processes and Materials of Manufacture*, 6th printing, Allyn and Bacon, Inc., Boston, 1969, p. 86.

*Primary Examiner*—Leonard E. Smith

*Attorney, Agent, or Firm*—Fleit, Jacobson, Cohn & Price

[57] ABSTRACT

A vane type rotary compressor comprising a housing having a cylindrical inner wall surface, a rotatable sleeve disposed in the housing for rotation about its own longitudinal axis, a rotor disposed in the sleeve for rotation about its own longitudinal axis, which is offset from the longitudinal axis of the sleeve, and a plurality of vanes carried by the rotor to extend in radial directions and maintained in contact with the inner surface of the sleeve to divide the interior of the sleeve into a plurality of working chambers. The rotatable sleeve is made of an Si-Al type alloy containing 12 to 25% by weight of Si. The sleeve is age hardened and provided with an anodic oxidation coating. A further coating of wear resistant resin may be provided on the outer surface of the sleeve.

7 Claims, 7 Drawing Figures

VANE TYPE COMPRESSOR HAVING AN IMPROVED ROTATABLE SLEEVE

The present invention relates to a displacement type rotary compressor and, more particularly, to a vane type rotary compressor having a plurality of vanes carried by a rotor eccentrically disposed in a housing. More specifically, the present invention pertains to a vane type rotary compressor in which a cylindrical sleeve is rotatably disposed in the housing and the vanes carried by the rotor are adapted to contact with the inner surface of the sleeve.

In conventional vane type compressors wherein vanes carried by an eccentric rotor are maintained in sliding contact with the inner surface of a housing, there have been problems of wear at the vane edges and at the housing inner surface, as well as seizures of the vane edges. Efforts therefore have been made to eliminate or decrease the problems by improving the materials and the treatments of the sliding surfaces, but no satisfactory results have been obtained.

Proposals have also been made in a vane type compressor to provide a structure by which slidable movements of the vane edges are significantly decreased. For example, Japanese utility model-publication No. 26-13667 discloses a vane type rotary compressor which includes a stationary housing having a cylindrical inner wall surface, a cylindrical sleeve rotatably disposed in the housing, and a rotor eccentrically disposed in the sleeve and carrying a plurality of vanes so that the outer edges of the vanes are maintained in contact with the inner surface of the sleeve. Japanese Patent publication No. 49-23322 proposes an improvement in this type of compressor. By the proposal, the rotatable sleeve is provided at the opposite axial ends with end plates to define a rotatable housing in the stationary housing so as to eliminate problems derived from slidable movements between the vane axial ends and the housing end walls.

These compressors are considered advantageous in that the sliding movements at the vane outer edges can significantly be decreased, however, there are further problems of sliding movements between the rotatable sleeve and the housing inner wall. When the compressor is made from an iron based material or an aluminum alloy, there will be produced serious problems of seizure between the sleeve and the housing. It has of course been known for example by a Japanese publication entitled "Displacement Type Compressors" published in June 1970 by the Sangyo Tosho K.K., to lubricate the sliding surfaces by supplying lubricant to the gap between the sleeve and the housing. However, such lubricant produces a drag against the rotation of the sleeve causing a power loss. Further, in the case where a leakage of lubricant occurs, the lubricant may be mixed with the output air so that this type of lubrication cannot be adopted in a compressor for an engine supercharging system.

It is an object of the present invention to provide a further improvement in a vane type rotary compressor having a rotatable sleeve.

Another object of the present invention is to provide a vane type compressor having a rotatable sleeve, which can be operated without lubrication of the sleeve.

Another object of the present invention is to provide a vane type rotary compressor having a rotatable sleeve of an increased strength to thereby prevent or suppress thermal deformation of the sleeve.

A further object of the present invention is to provide a vane type rotary compressor in which wear of vane edges can be decreased.

Still a further object of the present invention is to make a rotary compressor compact by decreasing the wall thickness of the rotatable sleeve.

According to the present invention, the above and other objects can be accomplished by a vane type rotary compressor comprising a housing having a cylindrical inner wall surface, a rotatable sleeve having outer and inner surfaces and disposed in the housing for rotation about a first longitudinal axis, a rotor disposed in the sleeve for rotation about a second longitudinal axis which is offset from the first longitudinal axis a plurality of vanes carried by the rotor to extend in radial directions and maintained in contact with the inner surface of the sleeve to divide the inside space of the sleeve into a plurality of working chambers, the rotatable sleeve being made of an Si-Al type alloy containing 12 to 25% in weight of Si, said sleeve being age hardened and provided with an anodic oxidation coating. For the age hardening of the sleeve, either of T4, T5, T6 and T7 treatments can be adopted. In the T4 treatment, the material is subjected to a temperature of 500° to 52O° C. for 2 hours for solution annealing and then quenched. Thereafter, age-hardening progresses at room temperature. In the T5 treatment, the material is heated to a temperature of 170° to 200° C. for 2 to 4 hours for the age hardening. The T6 treatment is a process in which the material is heated to a temperature of 500° to 520° C. for 2 to 4 hours for solution annealing and then quenched and thereafter heated to a temperature of 170° to 2OO° C. for 4 to 8 hours for age-hardening. In the T7 treatment, the material is subjected to a solution annealing and quenching as in the T6 treatment and then heated to a temperature of 200° to 230° C. for 4 to 8 hours for age-hardening. Throught the age-hardening process, it is possible to have the Si particles uniformly dispersed in the material so that the strength of the sleeve can be significantly increased. This is also effective to prevent or suppress wear of the vanes particularly where the vanes are formed by a carbon based material. The anodic oxidation coating on the sleeve provides a further increase in the strength of the sleeve so that it becomes possible to decrease the wall thickness of the sleeve without any danger of thermal deformation. Thus, the compressor can consequently be made compact and it becomes possible to prevent uneven wear of the vanes, which may otherwise be produced in use due to unsteady movements of the vanes.

The above and other objects and features of the present invention will become apparent from the following description of a preferred embodiment taking reference to the accompanying drawings, in which.

Figure 1:
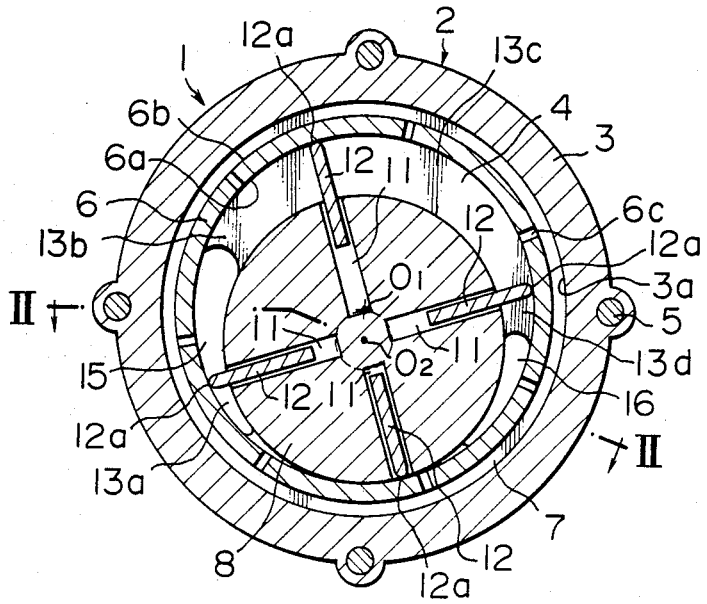
FIG. 1 is a cross-sectional view of a vane type rotary compressor to which the present invention can be applied.
Figure 2:
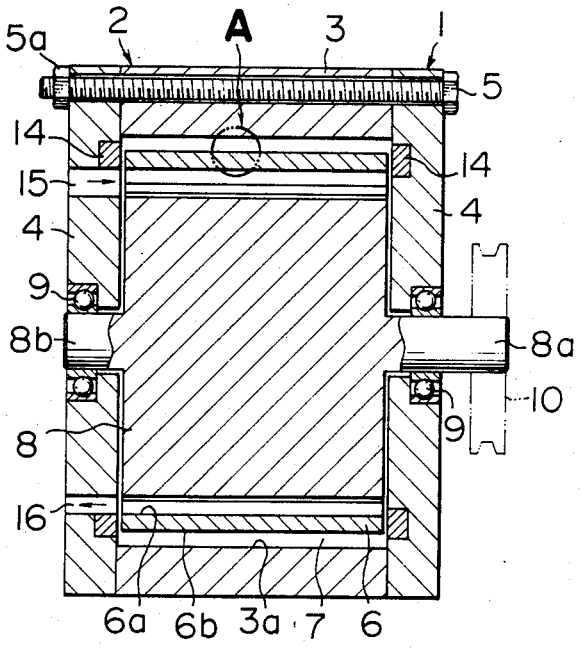
FIG. 2 is a sectional view taken substantially along the line II—II in FIG. 1.
Figure 3:
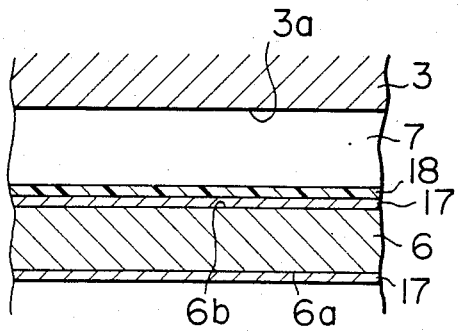
FIG. 3 is an enlarged view of the portion encircled by a circle A in FIG. 2.

Referring to the drawings, particularly to FIGS. 1 through 3, there is shown a vane type compressor 1 including a casing 2 which is comprised of a housing 3 and a pair of and plates 4 attached by bolts 5 and nuts 5*a* to the opposite axial ends of the housing 3. The housing 3 has a cylindrical inner wall surface 3*a* and there is disposed in the housing 3 a cylindrical sleeve 6 having an inner surface 6*a* and an outer surface 6*b*. The sleeve 6 is disposed coaxially with the cylindrical inner wall surface 3*a* of the housing 3 for rotation about a longitudinal axis $O_1$. In the sleeve 6, there is further disposed a rotor 8 which is rotatable about a longitudinal axis $O_2$ offset from the axis $O_1$ The rotor is formed with four radially extending grooves 11 which slidably receive vanes 12. The rotor 8 is provided at the opposite axial ends with shafts 8*a* and 8*b* which are supported through bearings 9 by the end plates 4. To the shaft 8*a* there is secured a pulley 10 through which the rotor 8 is connected with a drive power source (not shown).

One or each of the end plates 4 is formed with an inlet port 15 and an outlet port 16. The vanes 12 divide the interior of the sleeve 6 into four working chambers 13*a*, 13*b*, 13*c* and 13*d*, of which the volumes cyclically change as the rotor 8 rotates. The sleeve 6 is formed with a plurality of apertures 6*c* so that compressed air is introduced from the working chambers to a gap 7 defined between the housing 3 and the sleeve 6 to provide a pneumatic bearing. In FIGS. 1 through 3, the size of gap 7 is exaggerated as shown, but the gap is in actual practice very small and the value may be 30 to 50 microns. The end plates 4 are provided at the inner surface with ring-shaped side seals 14 which are located so as to confront with the axial ends of the sleeve 6.

In operation, the vanes 12 rotate together with the rotor 8 and are centrifugally forced into contact at their radially outer edges 12*a* with the inner surface 6*a* of the sleeve 6. The sleeve 6 is then forced to rotate under the friction force produced between the vanes 12 and the sleeve 6, so that sliding movements between the edges 12*a* and the inner surface 6*a* of the sleeve can significantly be decreased.

The rotatable sleeve 6 is made of an Si-Al type alloy containing 12 to 25% of Si. The material is at first cast to form a cylindrical blank and subjected to a heat treatment under either of the T4, T5, T6 and T7 processes. Thereafter, the blank is subjected to an anodic oxidation treatment to form anodic coatings 17 on the inner and outer surfaces 6*a* and 6*b* as shown in FIG. 3. Preferably, the coating 17 is 100 to 300 microns thick. With the coating thickness less than 100 microns, no significant improvement can be obtained in respect of the resistance to the thermal deformation. Coatings thicker than 300 microns are difficult to manufacture. With regard to the material for the rotatable sleeve 6, the Si content less than 12% cannot provide an adequate strength so that an acceptably large thermal deformation will be produced in use. With a Si content greater than b 25%, it becomes difficult to manufacture the sleeve and cracks may be produced during heat treatment. The heat treatment step is effective to make the Si content into particulate forms and establish a uniform distribution of the Si particles throughout the sleeve. Thus, the sleeve 6 becomes less harmful to the vanes, particularly when the vanes are made from a carbon based material and the wear of the vane edges can significantly be decreased.

The anodic oxidation coatings 17 provide additional improvements in the strength of the sleeve 6. Further, the coating 17 on the inner surface 6*a* of the sleeve 6 covers the Si particles which may otherwise be exposed to the surface 6*a*. Therefore, it becomes possible to prevent or significantly decrease wear of the vanes.

When desired, the sleeve 6 may be formed at the outer surface with a coating 18 of a wear-resistant resin as shown in FIG. 3. For the purpose, use may be made of epoxy resin or polyimide resin dispersed with 10 to 120 parts by volume of solid lubricant and 5 to 50 parts by volume of metal flakes for 100 parts by volume of the resin. As for the solid lubricant, either of molybdenum disulfide, boron nitride, graphite and fluoric resin powders can be used. Further, aluminum flakes may be used as the metal flakes. As an example, the coating 18 may contain 19 parts by volume of aluminum flakes and 30 parts by volume of graphite particles for 100 parts by volume of epoxy resin. The coating 18 may be 100 to 300 microns thick and it will be effective in decreasing the drag which may be produced between the inner wall surface 3*a* of the housing 3 and the rotatable sleeve 6.

EXAMPLES

Test examples were prepared as follows.

The housings 3: The housings 3 were formed from an aluminum based alloy meeting the requirements of AC4C in accordance with Japanese Industrial Standard JIS-H-5202 and hard Cr platings were made on the inner wall surfaces 3*a*.

The Sleeves 6: The sleeves 6 were formed from an Si-Al type alloy having the compositions shown in Table 1.

TABLE 1

| Si—Al alloy (in weight %) | | | | | |
|---|---|---|---|---|---|
| Cu | Si | Mg | Fe | Ni | Al |
| 2.0 | 20 | 1.2 | ≦0.6 | 1.2 | balance |

The sleeves 6 were then heat treated under the T6 process wherein they were heated to 500° C. for 3 hours for solution annealing, followed by quenching in water, and then heated to 180° C. for 6 hours for age hardening. Thereafter, the sleeves 6 were subjected to an anodic oxidation process. In Example 1, only the inner surfaces were formed with anodic coatings 17 of 220 microns thick. In Example 2, both the outer and inner surfaces were formed with such coatings 17. The outer surfaces of the sleeves 6 were then formed with resin coatings 18 having the compositions shown in Table 2.

TABLE 2

| Resin Coating parts by (volume) | | |
|---|---|---|
| Epoxy Resin | Al Flakes | Graphite Powders |
| 100 | 19 | 30 |

Vane material: Carbon
Compressor Displacement: 400 cc

The compressors were then operated at 6000 rpm for 5 hours and the driving torque was measured at the start and the end of the test. The results are shown in FIG. 4.

For the purpose of comparison, test samples were also prepared with rotatable sleeves which do not meet the present invention. In comparative sample 1, the sleeve was formed at the outer surface with the resin coating after the T6 treatment without the anodic oxidation treatment. In comparative sample 2, the sleeve was subjected to the anodic oxidation treatment without the heat treatment and formed with the resin coating at the outer surface. The same tests were made on these samples 1 and 2. The results are also shown in FIG. 4.

Figure 4:
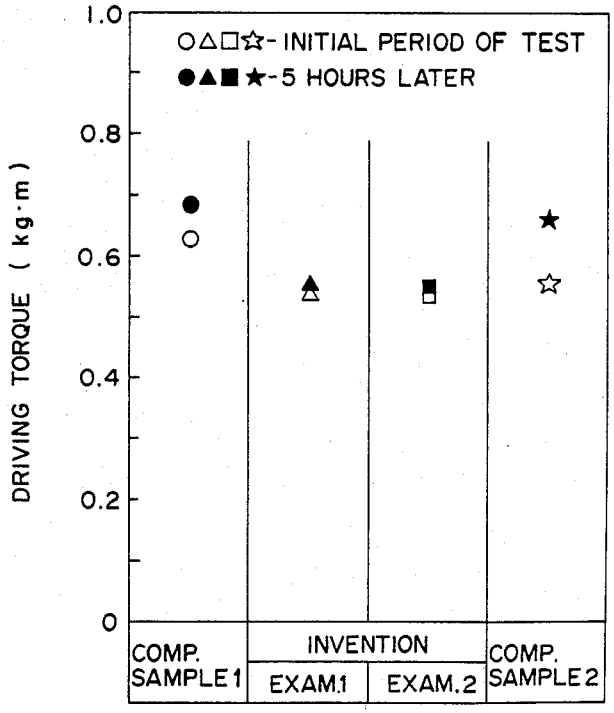
FIG. 4 is a diagram showing the effect of the T6 treatment and the anodic oxidation treatment on the rotor driving torque.

It will be noted in FIG. 4 that the compressors in accordance with the present invention show very small driving torque as compared with the comparative samples 1 and 2. Further, the compressors of the present invention show very little change in the driving torque between the start and the end of the test.

Figure 5:
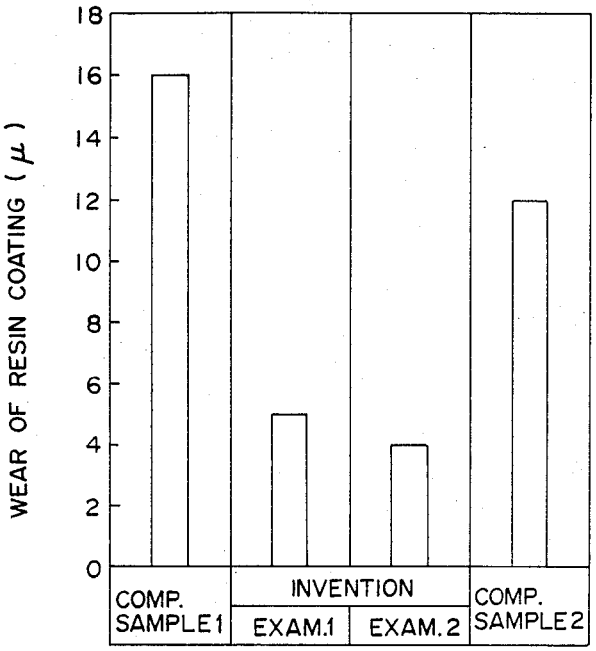
FIG. 5 is a diagram showing wear of the resin coatings.
Figure 6:
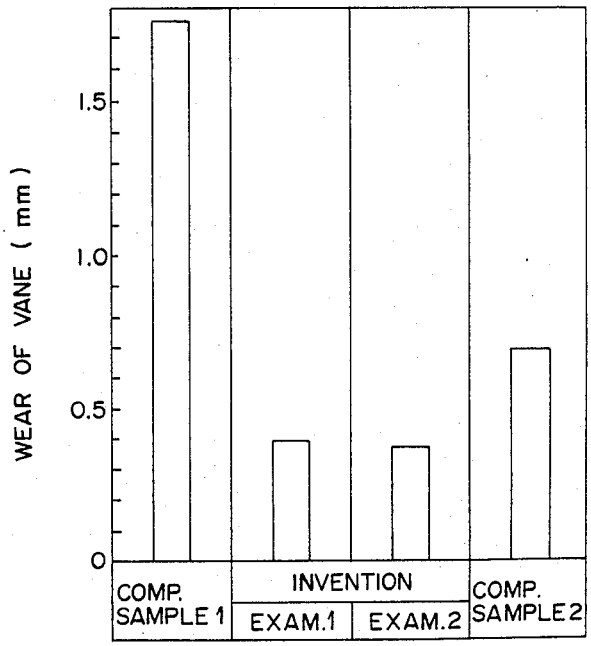
FIG. 6 is a diagram showing wear of vanes made from carbon based material.

After operation for 5 hours, the amounts of wear of the outer surfaces of the sleeves were measured. The results are shown in FIG. 5. In FIG. 6, there are also shown the amounts of wear of the vanes. In FIGS. 5 and 6, it will be noted that the compressors embodying the features of the present invention show significant improvements in wear of both the sleeve outer surface and the vanes.

Figure 7:
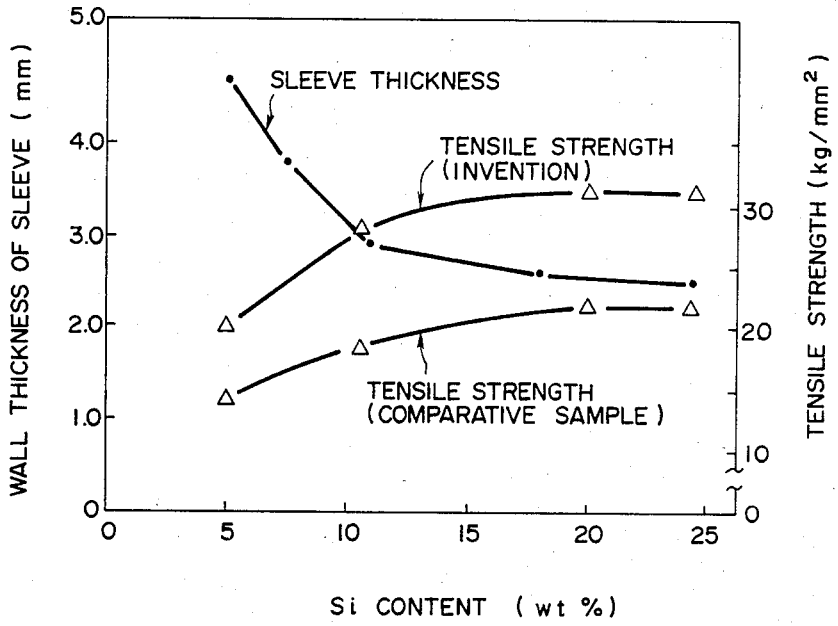
FIG. 7 is a diagram showing further effects of the present invention.

Further tests were performed with sleeves of different Si contents and different treatments. In one type, the sleeves were prepared without anodic oxidation treatments and heat treatments. In the other type, the sleeves were subjected to the T6 treatments and thereafter to anodic oxidation treatments. In each of the two types, four sleeves respectively having the Si contents of 5%, 12%, 20% and 24% were prepared for tensile strength tests. The test results are shown in FIG. 7. It will be noted in FIG. 7 that the combination of the heat treatment and the anodic oxidation treatment provides a significant increase in the tensile strength as the Si content increases. Thus, it is possible to decrease the thickness of the sleeve by increasing the Si content as shown in FIG. 7. On the other hand, the tensile strength cannot be increased sufficiently without heat treatment even when the Si content is increased. It will therefore be understood that the present invention is effective to decrease the wall thickness of the sleeve, so that various advantages can be obtained.

In order to investigate the effects of the Si content on the driving torque and the wear of the resin coating on the sleeve outer surface, further tests were carried out with compressors having sleeves which were heat treated under the T6 process and formed with anodic coatings of 220 microns on the outer and inner surfaces. The test results are shown in Table 3 together with further details of the sleeves.

TABLE 3

| Sleeve | | | | |
|---|---|---|---|---|
| Wall Thickness (mm) | Si Content (wt. %) | Outer Resin Coating (vol. part) | Driving Torque (kg. m) | Wear of Outer resin Coating (μ) |
| 2.5 | 5.0 | Epoxy Resin (100) | 0.68 | 18 |
| | 12 | Al Flakes (19) | 0.53 | 4 |
| | 20 | Fluoric Resin Powder (30) | 0.50 | 2 |
| 2.5 | 5.0 | Epoxy resin (100) | 0.69 | 16 |
| | 12 | Al Flakes (19) | 0.53 | 3 |
| | 20 | Graphite Powder (15) | 0.51 | 2 |

It will be noted in Table 3 that with the Si content greater than 12 weight % it is possible to decrease the driving torque and the wear of the outer resin coating.

The invention has thus been shown and described with reference to specific examples, however, it should be noted that the invention is in no way limited to the details of such examples but changes and modifications may be made without departing from the scope of the appended claims.

What is claimed is:

1. A vane type rotary compressor comprising a housing having a cylindrical inner wall surface, a rotatable sleeve having outer and inner surfaces and disposed in the housing for rotation about a first longitudinal axis, a rotor disposed in the sleeve for rotation about a second longitudinal axis which is offset from the first longitudinal axis, a plurality of vanes carried by the rotor to extend in radial directions and maintained in contact with the inner surface of the sleeve to divide the interior of the sleeve into a plurality of working chambers, the rotatable sleeve being made of an Si-Al type alloy containing 12 to 25% by weight of Si, said sleeve being age hardened so that Si particles are distributed substantially uniformly therein, said sleeve having an anodic oxidation coating of 100 to 300 microns thickness on at least the outer surface thereof and a coating of wear resistant resin overlying the anodic oxidation coating formed on the outer surface thereof.

2. A rotary compressor in accordance with claim 1 wherein said resin is selected from the group consisting of epoxy resins and polyimide resins.

3. A rotary compressor in accordance with claim 2 wherein said resin includes a solid lubricant selected from the group consisting of molybdenum disulphide, boron nitride, graphite, and fluoric resin powders.

4. A rotary compressor in accordance with claim 2 wherein said resin includes metal flakes.

5. A rotary compressor in accordance with claim 3 wherein said resin includes metal flakes.

6. A rotary compressor in accordance with claim 5 wherein said resin coating is from about 100 to about 300 microns thick.

7. A rotary compressor in accordance with claim 1 in which said resin coating contains 10 to 120 volume parts of solid lubricant and 5 to 50 volume parts of metal flakes in 100 volume parts of the resin.

* * * * *